US006948995B2

(12) United States Patent
Ishikura et al.

(10) Patent No.: US 6,948,995 B2
(45) Date of Patent: Sep. 27, 2005

(54) MANUFACTURE METHOD FOR ELECTRON-EMITTING DEVICE, ELECTRON SOURCE, LIGHT-EMITTING APPARATUS, AND IMAGE FORMING APPARATUS

(75) Inventors: Junri Ishikura, Tokyo (JP); Makoto Kameyama, Chiba (JP); Takeo Tsukamoto, Kanagawa (JP); Yasuyuki Saito, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 246 days.

(21) Appl. No.: 10/234,213

(22) Filed: Sep. 5, 2002

(65) Prior Publication Data

US 2003/0048055 A1 Mar. 13, 2003

(30) Foreign Application Priority Data

Sep. 10, 2001 (JP) ..... 2001-273946
Aug. 23, 2002 (JP) ..... 2002-243202

(51) Int. Cl.[7] ..... H01J 1/30
(52) U.S. Cl. ..... 445/51; 445/46
(58) Field of Search ..... 313/309–311, 495–497, 313/346 R; 445/35, 46, 50, 51

(56) References Cited

U.S. PATENT DOCUMENTS

| | | | | |
|---|---|---|---|---|
| 4,728,851 A | | 3/1988 | Lambe | 313/309 |
| 4,816,289 A | | 3/1989 | Komatsu et al. | 423/447.3 |
| 4,900,483 A | | 2/1990 | Witzke et al. | 313/309 |
| 4,904,895 A | | 2/1990 | Tsukamoto et al. | 313/336 |
| 4,956,578 A | | 9/1990 | Shimizu et al. | 315/3 |
| 5,066,883 A | * | 11/1991 | Yoshioka et al. | 313/309 |
| 5,185,554 A | | 2/1993 | Nomura et al. | 313/495 |
| 5,192,240 A | | 3/1993 | Komatsu | 445/24 |
| 5,214,346 A | | 5/1993 | Komatsu | 313/309 |
| 5,382,867 A | | 1/1995 | Yuji et al. | 313/309 |
| 5,443,859 A | | 8/1995 | Nagata | 427/122 |
| 5,458,784 A | | 10/1995 | Baker et al. | 210/674 |
| 5,500,200 A | | 3/1996 | Mandeville et al. | 423/447.3 |
| 5,543,684 A | | 8/1996 | Kumar et al. | 313/495 |

(Continued)

FOREIGN PATENT DOCUMENTS

| | | | |
|---|---|---|---|
| CN | 1181607 A | 5/1998 | |
| EP | 0 290 026 A1 B1 | 11/1988 | H01J/3/02 |
| EP | 0 394 698 A2 | 10/1990 | H01J/1/30 |

(Continued)

OTHER PUBLICATIONS

Patent Abstracts of Japan, Publication No. 11162334, Jun. 18, 1999.

(Continued)

*Primary Examiner*— Vip Patel
*Assistant Examiner*—Glenn Zimmerman
(74) *Attorney, Agent, or Firm*—Fitzpatrick, Cella, Harper & Scinto

(57) ABSTRACT

A method of manufacturing an electron-emitting device having excellent electron emission characteristics is provided in which fibers comprising carbon as the main composition are fixed (bonded) to a substrate in a desired area and at a desired density with simple processes and inexpensive manufacture cost, and a manufacture method for an electron source, a light-emitting apparatus and an image forming apparatus using such electron-emitting devices is provided. A method of manufacturing an electron-emitting device made of material comprising carbon as main composition by an aerosol type gas deposition method in which the material comprising carbon as the main composition is aerosolized and transported together with gas, and tightly attached (bonded) to a substrate via a nozzle.

23 Claims, 4 Drawing Sheets

U.S. PATENT DOCUMENTS

| | | | | |
|---|---|---|---|---|
| 5,551,903 A | | 9/1996 | Kumar et al. | 445/24 |
| 5,577,943 A | | 11/1996 | Vickers et al. | 445/24 |
| 5,612,587 A | | 3/1997 | Itoh et al. | 313/309 |
| 5,618,875 A | | 4/1997 | Baker et al. | 524/495 |
| 5,623,180 A | | 4/1997 | Jin et al. | 313/310 |
| 5,690,997 A | | 11/1997 | Grow | 427/249.1 |
| 5,726,524 A | | 3/1998 | Debe | 313/309 |
| 5,770,918 A | | 6/1998 | Kawate et al. | 313/495 |
| 5,773,921 A | | 6/1998 | Keesman et al. | 313/309 |
| 5,847,495 A | | 12/1998 | Yamanobe et al. | 313/310 |
| 5,872,541 A | | 2/1999 | Yoshioka et al. | 345/74.1 |
| 5,935,639 A | | 8/1999 | Sullivan et al. | 427/78 |
| 5,965,267 A | | 10/1999 | Nolan et al. | 428/408 |
| 5,973,444 A | | 10/1999 | Xu et al. | 313/309 |
| 5,981,305 A | | 11/1999 | Hattori | 438/20 |
| 5,982,091 A | | 11/1999 | Konishi | 313/495 |
| 5,986,389 A | | 11/1999 | Tsukamoto | 313/310 |
| 6,087,765 A | | 7/2000 | Coll et al. | 313/309 |
| 6,129,602 A | | 10/2000 | Yamanobe | 445/24 |
| 6,135,839 A | | 10/2000 | Iwase et al. | 445/24 |
| 6,147,449 A | | 11/2000 | Iwasaki et al. | 313/495 |
| 6,171,162 B1 | | 1/2001 | Iwasaki et al. | 445/6 |
| 6,184,610 B1 | | 2/2001 | Shibata et al. | 313/309 |
| 6,204,597 B1 | | 3/2001 | Xie et al. | 313/310 |
| 6,228,904 B1 | | 5/2001 | Yadav et al. | 523/210 |
| 6,231,413 B1 | | 5/2001 | Tsukamoto | 445/24 |
| 6,246,168 B1 | | 6/2001 | Kishi et al. | 313/495 |
| 6,280,802 B1 | | 8/2001 | Akedo et al. | 427/561 |
| 6,283,812 B1 | | 9/2001 | Jin et al. | 445/24 |
| 6,288,494 B1 | | 9/2001 | Tsukamoto et al. | 315/169.1 |
| 6,290,564 B1 | * | 9/2001 | Talin et al. | 445/50 |
| 6,313,572 B1 | | 11/2001 | Yamada | 313/310 |
| 6,331,690 B1 | | 12/2001 | Yudasaka et al. | 219/121.6 |
| 6,333,016 B1 | | 12/2001 | Resasco et al. | 423/447.3 |
| 6,390,612 B1 | | 5/2002 | Kotaki et al. | 347/85 |
| 6,400,091 B1 | | 6/2002 | Deguchi et al. | 315/169.1 |
| 6,413,487 B1 | | 7/2002 | Resasco et al. | 423/447.3 |
| 6,417,606 B1 | * | 7/2002 | Nakamoto et al. | 313/336 |
| 6,445,006 B1 | | 9/2002 | Brandes et al. | 257/76 |
| 6,448,709 B1 | | 9/2002 | Chuang et al. | 313/497 |
| 6,455,021 B1 | | 9/2002 | Saito | 423/447.3 |
| 6,471,936 B1 | | 10/2002 | Chen et al. | 423/658.2 |
| 6,472,814 B1 | | 10/2002 | Yamanobe et al. | 313/495 |
| 6,630,772 B1 | | 10/2003 | Bower et al. | 313/311 |
| 2001/0006232 A1 | | 7/2001 | Choi et al. | 257/10 |
| 2002/0009637 A1 | | 1/2002 | Murakami et al. | 429/213 |
| 2002/0031972 A1 | | 3/2002 | Kitamura et al. | 445/3 |
| 2002/0047562 A1 | | 4/2002 | Kitamura et al. | 315/169.3 |
| 2002/0136896 A1 | | 9/2002 | Takikawa et al. | 428/408 |
| 2002/0146958 A1 | | 10/2002 | Ono et al. | 445/24 |
| 2003/0048056 A1 | | 3/2003 | Kitamura et al. | 313/311 |

FOREIGN PATENT DOCUMENTS

| | | | |
|---|---|---|---|
| EP | 0 433 507 A1 | 6/1991 | D01F/9/127 |
| EP | A1 443 865 | 8/1991 | H01J/21/10 |
| EP | 0 290 026 B1 | 2/1993 | H01J/3/02 |
| EP | 0 535 953 B1 | 4/1993 | H01J/1/30 |
| EP | 0 614 209 A1 | 9/1994 | H01J/31/12 |
| EP | 0 535 953 B1 | 1/1996 | H01J/1/30 |
| EP | 0 716 439 A1 | 6/1996 | H01J/3/02 |
| EP | 0 758 028 A2 | 2/1997 | D01F/9/127 |
| EP | 0 797 233 A2 | 9/1997 | H01J/1/30 |
| EP | 0 836 217 A1 | 4/1998 | H01J/29/94 |
| EP | A1 871 195 | 10/1998 | H01J/1/30 |
| EP | 0 913 508 A2 | 5/1999 | D01F/9/127 |
| EP | 0 913 508 A3 | 5/1999 | D01F/9/127 |
| EP | 0 936 650 A1 | 8/1999 | H01J/3/02 |
| EP | A1 936 650 | 8/1999 | H01J/3/02 |
| EP | 0 980 089 A1 | 2/2000 | H01J/1/30 |
| EP | 0 451 208 B1 | 3/2000 | D01F/9/12 |
| EP | 0 986 084 A2 | 3/2000 | H01J/1/30 |
| EP | 0 989 579 A2 | 3/2000 | |
| EP | 1 022 763 A1 | 7/2000 | H01J/9/02 |
| EP | 1 096 533 A1 | 5/2001 | |
| EP | 1 102 299 A1 | 5/2001 | |
| EP | 1 113 478 A1 | 7/2001 | |
| EP | 1 117 118 A1 | 7/2001 | H01J/1/312 |
| EP | 1 120 877 A1 | 8/2001 | |
| EP | 1 122 344 A2 | 8/2001 | D01F/9/127 |
| EP | 1 187 161 A1 | 3/2002 | H01J/3/02 |
| EP | 0 758 028 B1 | 9/2002 | D01F/9/127 |
| GB | 2 308 495 A | 6/1997 | |
| JP | 1-309242 | 12/1989 | |
| JP | 2-112125 | 4/1990 | H01J/1/30 |
| JP | 3-20941 | 1/1991 | H01J/31/12 |
| JP | 03-260119 | 11/1991 | D01F/9/127 |
| JP | 03-295131 | 12/1991 | H01J/1/30 |
| JP | 04-212236 | 3/1992 | H01J/1/30 |
| JP | 05-159696 | 6/1993 | H01J/1/30 |
| JP | 05-198253 | 8/1993 | H01J/1/30 |
| JP | 5-211029 | 8/1993 | H01J/1/30 |
| JP | 05-274997 | 10/1993 | H01J/1/30 |
| JP | 7-6714 | 1/1995 | H01J/31/12 |
| JP | 8-115652 | 5/1996 | |
| JP | 08-115652 | 5/1996 | H01J/1/30 |
| JP | 8-264109 | 10/1996 | H01J/1/30 |
| JP | 08-298068 | 11/1996 | H01J/1/30 |
| JP | 9-82214 | 3/1997 | H01J/1/30 |
| JP | 09-188600 | 7/1997 | C30B/29/62 |
| JP | 10-223133 A | 8/1998 | |
| JP | 10-289650 | 10/1998 | H01J/1/30 |
| JP | 11-139815 | 5/1999 | C01B/31/02 |
| JP | 11-162334 | 6/1999 | |
| JP | 11-194134 | 7/1999 | G01N/37/00 |
| JP | 11-232997 | 8/1999 | H01J/1/30 |
| JP | 2000-57934 | 2/2000 | |
| JP | 2000-86216 | 3/2000 | |
| JP | 2000-90809 | 3/2000 | |
| JP | 2000-95509 | 4/2000 | C01B/31/02 |
| JP | 2002-123711 | 4/2000 | |
| JP | 2000-141056 | 5/2000 | |
| JP | 2000-208028 | 7/2000 | H01J/1/304 |
| JP | 2000-212766 | 8/2000 | |
| JP | 2000-223005 | 8/2000 | H01J/1/304 |
| JP | 2000/277003 | 10/2000 | H01J/9/02 |
| JP | 2001-288625 A | 1/2001 | D01F/9/127 |
| JP | 2001-52598 | 2/2001 | H01J/1/316 |
| JP | 2001-162600 | 6/2001 | B82B/1/00 |
| WO | WO 89/07163 | 8/1989 | D01F/9/12 |
| WO | WO 90/07023 | 6/1990 | D01F/9/12 |
| WO | WO 98/05920 | 2/1998 | G01B/7/34 |
| WO | WO 99/58748 | 11/1999 | D01F/9/127 |
| WO | WO 01/26130 A1 | 4/2001 | |
| WO | WO 01/93292 A1 | 12/2001 | H01J/1/304 |

OTHER PUBLICATIONS

W. Zhu Et Al., *Electron Field Emission From Nanostructured Diamond and Carbon Nanotubes*, Solid State Electronics, vol. 45, 2001, pp. 921–928.

J.M. Bonard Et Al., *Field Emission From Carbon Nanotubes: The First Five Years*, Solid State Electronics, vol. 45, 2001, pp. 893–914.

R.T.K. Baker et al., "Formation of Carbonaceous Deposits from the Platinum–Iron Catalyzed Decomposition of Acyetylene," 37 J. Catal. 101–105 (1975).

R.T.K. Baker, "Catalytic Growth of Carbon Filaments," 27 (3) Carbon 315–323 (1989).

S. Iijima, "Helical Microtubules of Graphitic Carbon," Nature, vol. 345, 56–58 (1991).
T. W. Ebbesen et al., "Large–Scale Synthesis of Carbon Nanotubes," Nature, vol. 358, 220–222 (1992).
W. A. DeHeer et al., "Aligned Carbon Nanotube Films: Production and Optical and Electronic Properties," Science vol. 268, 845–847 (1995).
T. Guo et al., "Catalytic Growth of Single–Walled Nanotubes by Laser Vaporization," Chem Phys. Lett., vol. 243, 49–54 (1995).
A. G. Rinzler et al., "Unraveling Nanotubes: Field Emisson from an Atomic Wire," Science, vol. 269, 1550–1553 (1995).
W. A. DeHeer et al., "A Carbon Nanotube Field–Emission Electron Source," Science, vol. 270, 1179–1180 (1995).
T. Kyotani et al., "Preparation of Ultrafine Carbon Tubes in Nanochannels of an Anodic Aluminum Oxide Film," Chem. Mater., vol. 8, 2109–2113 (1996).
A. Thess et al., "Crystalline Ropes of Metallic Carbon Nanotubes," Science, vol. 273 483–487 (1996).
H. Dai et al., "Single–Wall Nanotubes Produced by Metal–Catalyzed Disproportionation of Carbon Monoxide," Chem. Phys. Lett., vol. 260, 471–475 (1996).
H. Dai et al., "Nanotubes as Nanoprobes in Scanning Probe Microscopy," Nature, vol. 384, 147–150 (1996).
A. C. Dillon et al., "Storage of Hydrogen in Single–Walled Carbon Nanotubes," Nature, vol. 386, 377–379 (1997).
W.P. Dkye et al., "Field Emission", *Advances in Electronics and Electron Physics*, vol. 8, (1956) pp. 89–185.
C.A. Spindt et al., "Physical Properties of Thin–Film Field Emission Cathodes with Molybdenum Cones", *Journal of Applied Physics*, vol. 47, No. 12 (1976), pp. 5248–5263.
C.A. Mead, "Operation of Tunnel–Emission Devices", *Journal of Applied Physics*, vol. 32, No. 4, (1961), pp. 646–652.
Toshiaki Kusunoki et al., "Fluctuation–Free Electron Emission from Non–Formed Metal–Insulator–Metal (MIM) Cathodes Fabricated by Low Current Anodic Oxidation", *Japanese Journal of Applied Physics*, vol. 32 No. 11B, (1993), pp. L1695–1967.
M.I. Elinson et al., "The Emission of Hot Electrons and the Field Emission of Electrons from Tin Oxide", *Radio Engineering and Electronic Physics*, (1965) pp. 1290–1296.
G. Dittmer, "Electrical Conduction and Electron Emission of Discontinuous Thin Films", *Thin Solid Films*, vol. 9, (1972) pp. 317–329.
M. Hartwell et al., "Strong Electron Emission from Patterned Tin–Indium Oxide Thin Films", IEEE Trans. Ed. Conf., (1983) pp. 519–521.
Hisashi Araki et al., Electroforming and Electron Emission of Carbon Thin Films, Journal of the Vacuum Society of Japan, 1983 (with English Abstract on p. 22).
Rodriguez et al., "Catalytic Engineering of Carbon Nanostructures," Langmuir 11, 3862–3866 (1995).
A.M. Rao et al., "In Situ–grown Carbon Nanotube Array of with Excellent Field Emission Characteristics," Applied Physics Letter, vol. 76, No. 25, pp. 3813–3815 (2000).
Cheol Jin Lee et al., "Carbon Nanofibers Grown on Sodalime Glass at 500° C. Using Thermal Chemical Vapor Deposition," Chemical Physics Letters 340, pp. 413–418 (2001).
Sashiro Uemura et al., "Carbon Nanotube FED with Graphite–Nano–Fiber Emitters," ISSN 1083–1312, pp. 398–401. (2000).
Q. H. Wang et al., "A Nanotube–Based Field–Emission Flat Panel Display," Applied Physics Letters, vol. 72, No. 22, Jun. 1998, pp. 2912–2913.

* cited by examiner

MANUFACTURE METHOD FOR ELECTRON-EMITTING DEVICE, ELECTRON SOURCE, LIGHT-EMITTING APPARATUS, AND IMAGE FORMING APPARATUS

BACKGROUND OF THE INVENTION

1. Field of the Invention

The present invention relates to a method of manufacturing electron-emitting devices, electron sources, light-emitting apparatuses and image forming apparatuses. Image forming apparatuses may be display apparatuses for television broadcasting, display apparatuses for television conference systems and computers and the like, optical printers using photosensitive drums and the like.

2. Related Background Art

Two types of electron emitting-devices are known, thermionic cathode devices and cold cathode devices. Known cold cathode devices include field emission devices, metal/insulator/metal emission devices, and surface conduction electron-emitting devices. Image forming apparatuses using electron-emitting devices are required nowadays to have a high resolution. As the number of display pixels increases, a consumption power increases because of capacitances of electron-emitting devices being driven. It is therefore desired to reduce device capacitance, lower drive voltage and improve the efficiency of electron-emitting devices. It is also required that the electron emission characteristics of electron-emitting devices are uniform and devices can be easily manufactured. Recently, many proposals have been made to use carbon nanotubes as electron-emitting devices, carbon nanotubes being expected to meet such requirements.

Manufacturing and patterning methods for electron-emitting devices using carbon nanotubes have been proposed in various ways (as disclosed in Japanese Patent Laid-Open Application No. 11-162334, No. 2000-057934, No. 2000-086216, No. 2000-090809, U.S. Pat. No. 6,290,564, etc.). For example, by using resist, a dot pattern is formed in a substrate to dispose catalyst metal at desired positions and grow carbon nanotubes by using the catalyst metal as nuclei (JP-A-2000-086216). Assistants are attached to a substrate and carbon nanotubes are formed at desired positions of the substrate by plasma CVD in an electric field (JP-A-2000-057934). Carbon nanotubes are manufactured by arc discharge or by laser radiation to graphite and refined. Thereafter, the carbon nanotubes are dispersed in solution or resist liquid and this dispersion liquid is coated on a substrate (JP-A-2000-90809).

SUMMARY OF THE INVENTION

The device manufacture method which grows carbon nanotubes by using catalyst as nuclei requires a plurality of complicated processes because it is necessary to fix a metal catalyst to a substrate at proper size, proper particle diameter and proper pitch.

The device manufacture method which coats liquid dispersed with carbon nanotubes as described in JP-A-2000-90809 has an increased number of processes and requires a high cost because it is necessary to pattern the dispersion liquid in only desired areas of a substrate and to perform a post-process like a baking process.

The device manufacture method which uses adhesive as described in JP-A-11-162334 inevitably increases the number of processes because it is necessary to coat adhesive before disposing a plurality of a columnar graphite and perform a baking process after the disposing.

An object of the invention is to provide a method of manufacturing an electron-emitting device having excellent electron emission characteristics in which fibers comprising carbon as the main composition (as the main ingredients) are directly fixed (bonded) to a substrate (or a electrode disposed on a substrate) in a desired area and at a desired density with simple processes and inexpensive manufacturing cost, and to provide a manufacturing method for an electron source, a light-emitting apparatus and an image forming apparatus using such electron-emitting devices.

Specifically, the invention provides a method of manufacturing an electron-emitting device wherein a material comprising carbon as the main composition (as the main ingredients) is aerosolized and transported together with gas, and tightly attached (bonded) to a substrate via a nozzle.

The material comprising carbon as the main composition (as the main ingredients) may be fibers comprising carbon as the main composition (as the main ingredients. The fibers comprising carbon as the main composition (as the main ingredients) may be at least ones selected from a group consisting of graphite nanofibers, carbon nanotubes, amorphous carbon fibers and carbon nanohorns.

The invention provides a method of manufacturing an electron-emitting device, the method comprising: (A) a step of preparing fibers comprising carbon as main composition (as the main ingredients) in a first chamber; (B) a step of disposing a substrate in a second chamber; and (C) a step of colliding the fibers comprising carbon as the main composition (as the main ingredients) with the substrate via a transport tube communicating with the first and second chamber by setting a pressure in the first chamber higher than a pressure in the second chamber, to fix (bonded) the fibers comprising carbon as the main composition (as the main ingredients) to the substrate.

The substrate on which the carbon fibers are used also as a negative electrode material of a fuel cell, a negative electrode material of a secondary cell and a hydrogen absorbing substance.

The fibers comprising carbon as the main composition (as the main ingredients) may be dispersed in gas in the first chamber. The gas may be non-oxidizing gas.

The inside of the second chamber may be in a reduced pressure state. The fibers comprising carbon as the main composition (as the main ingredients) may be aerosolized in the first chamber.

The fibers comprising carbon as the main composition (as the main ingredients) can be fixed (bonded) to the substrate by heat energy generated when the fibers comprising carbon as the main composition collides with the substrate. The fibers comprising carbon as the main composition may be at least ones selected from a group consisting of graphite nanofibers, carbon nanotubes, amorphous carbon fibers and carbon nanohorns.

A first conductive layer may be disposed on the substrate and the fibers comprising carbon as the main composition may be fixed (bonded) to the first conductive layer. A second conductive layer may be disposed on the substrate, the second conductive layer being spaced apart from the first conductive layer.

The invention provides a method of manufacturing an electron source comprising a plurality of electron-emitting devices wherein the electron-emitting device is manufactured by the above-described method of the invention.

The invention provides a method of manufacturing an image forming apparatus comprising an electron source and a light emitting member wherein the electron source is manufactured by the above-described method of the invention.

The invention provides a method of manufacturing a light-emitting apparatus comprising electron-emitting devices and light-emitting members wherein the electron-emitting device is manufactured by the above-described method of the invention.

The manufacture method of the invention is not a method of forming catalyst on a substrate and growing fibers comprising carbon as the main composition by using the catalyst as nuclei. As will be later described, the manufacture method of the invention directly fixes fibers comprising carbon as the main composition to a substrate. More specifically, aerosolized fibers comprising carbon as the main composition are ejected from a nozzle and collide with the substrate in a desired area to fix (bond) the fibers to the desired area of the substrate without using adhesive.

According to the method of the invention, fibers comprising carbon as the main composition are aerosolized and directly ejected toward a substrate together with gas. Therefore, the fibers fixed to the substrate can be disposed at an angle perpendicular to or substantially perpendicular to the substrate surface. Since the fibers can be fixed (bonded) vertically or approximately vertically to the substrate surface. An electric field can be concentrated upon a tip of each sharp fiber so that the electron-emitting device having stable and excellent electron emission characteristics can be manufactured. In the above described invention, it is noted that the fibers used to this invention are not limited to the fibers comprising carbon as the main composition. Therefore, fibers comprising metal (or substance having metallic characteristic) as the main composition can be also used in the invention described above. According to the method of the invention, it is not necessary to heat a substrate to a high temperature in order to grow and fix fibers to a device substrate as in conventional techniques. It is therefore possible to lower a power consumption and manufacture cost.

DETAILED DESCRIPTION OF THE PREFERRED EMBODIMENTS

In the present invention, the phrase "fibers comprising carbon as the main composition" may be replaced with a phrase "columnar substance comprising carbon as the main composition" or a phrase "linear substance comprising carbon as the main composition". Also in the present invention, the phrase "fibers comprising carbon as the main composition" may be replaced with a phrase "fibrous carbon" or a phrase "carbon fibers". Examples of "fibers comprising carbon as the main composition" are carbon nanotubes, graphite nanofibers, amorphous carbon fibers, carbon nanohorns with one closed end of a carbon nanotube, and mixtures of these. Among these, graphite nanofibers are most suitable.

One plane (sheet) of graphite is called a "graphen" or a "graphen sheet". More specifically, graphite comprises a plurality of stacked or layered carbon planes. Each carbon plane comprises a repeated hexagon having a carbon atom at each vertex thereof and having a covalent bond along each side thereof. The covalent bond is caused by sp2 hybrid orbitals of carbon atoms. Ideally, the distance (interval) between the neighboring carbon planes is $3.354\times10^{-10}$ m. Each carbon plane (sheet) is called a "graphen" or a "graphen sheet".

Figure 6A:
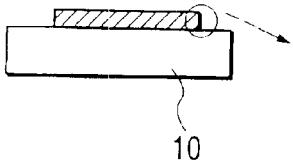
FIGS. 6A, 6B and 6C are schematic diagrams showing an example of fibers comprising carbon as the main composition.
Figure 6B:
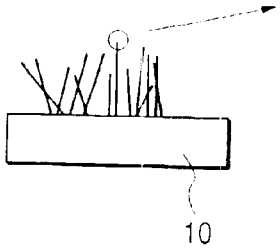
Figure 6C:
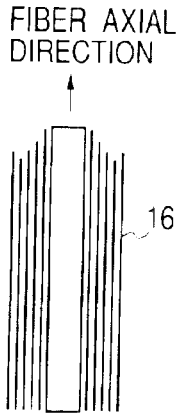
Figure 7A:
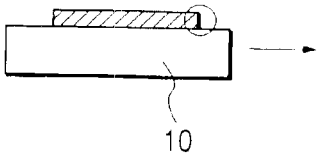
FIGS. 7A, 7B and 7C are schematic diagrams showing another example of fibers comprising carbon as the main composition.
Figure 7B:
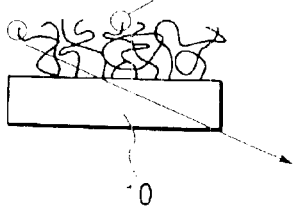
Figure 7C:
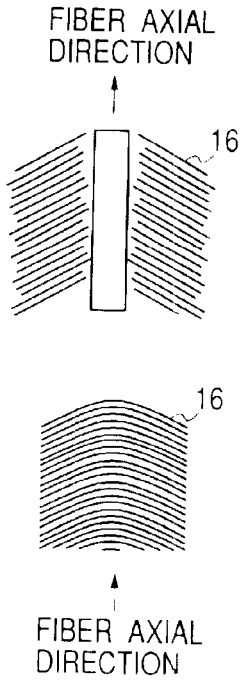

Examples of the structure of fibers comprising carbon as the main composition are schematically shown in FIGS. 6A to 6C and 7A to 7C. In FIGS. 6A to 6C and 7A to 7C, reference numeral 16 represents a graphen. The structure of fibers as observed at an optical microscope level (up to 1000 magnification) is schematically shown in the left (FIGS. 6A and 7A). The structure of fibers as observed at a scanning electron microscope (SEM) level (up to thirty thousand magnification) is schematically shown in the middle (FIGS. 6B and 7B). The structure of fibers as observed at a transmission electron microscope (TEM) level (up to one million magnification) is schematically shown in the right (FIGS. 6C and 7C).

As shown in FIGS. 6A to 6C, a graphen comprising a cylindrical shape along an elongated (longitudinal) direction (fiber axial direction) is called a carbon nanotube (multi-wall nanotube if the cylindrical shape is a multi-structure). If the tube end is open, the electron emission threshold value is lowest. In other words, the carbon nanotubes are fibrous substance comprising graphens disposed substantially parallel to the fiber axis.

Fibers comprising carbon formed at a relatively low temperature as the main composition are shown in FIGS. 7A to 7C. The fibers are made of a lamination of graphens (from this reason, the fibers are also called "graphite nanofibers"). More specifically, graphite nanofibers are fibrous substance made of a lamination of graphens stacked along the longitudinal direction (fiber axial direction). In other words, as shown in FIGS. 7A to 7C, the graphite nanofibers are fibrous substance made of a lamination of graphens whose plane is not parallel to the fiber axis.

Both the carbon nanotubes and graphite nanofibers have the electron emission threshold of about 1 V/$\mu$m or higher and about 10 V/$\mu$m or lower, and are suitable for the material of an emitter (an electron-emitting member) of an electron-emitting device of the invention.

An electron-emitting device comprising graphite nanofibers can emit electrons at a low intensity of the electric field, can provide a large emission current, can be manufactured easily, and provides stable and good electron emission characteristics. Comparing to the electron-emitting device comprising a plurality of carbon nanotubes, the electron-emitting device comprising a plurality of graphite nanofibers can be expected to obtain more electron emission current and/or stable electron emission. For example, an electron-emitting device can be formed by an emitter comprising of graphite nanofibers (or carbon nanotubes) and electrodes for controlling electron emission from the emitter. A light-emitting apparatus such as a lamp can be formed by using a light-emitting member which emits light upon irradiation of electrons emitted from graphite nanofibers (or carbon nanotubes).

An image forming apparatus such as a display can be formed by disposing a plurality of electron-emitting devices using graphite nanofibers (or carbon nanotubes) and providing an anode electrode comprising a light-emitting member such as a phosphor and a drive circuit for controlling a voltage to be applied to each electron-emitting device. An electron source, a light-emitting apparatus and an image forming apparatus using electron-emitting devices comprising graphite nanofibers (or carbon nanotubes) can stably and reliably emit electrons without maintaining the inside at a ultra high vacuum, and can be manufactured very easily and with high reliability because they emit electrons at a low intensity of the electric field.

Fibers comprising carbon as the main composition to be used by the invention may be manufactured by any one of manufacture methods. One of such fiber manufacturing methods comprises a first step of preparing a catalyst substance (substance for promoting deposition of carbon) and a second step of decompose carbon containing gas by using the catalyst substance. Whether carbon nanotubes are formed or graphite nanofibers are formed depends upon the kind of catalyst and a decomposition temperature.

For example, the carbon containing gas may be: hydrocarbon gas such as ethylene gas, methane gas, propane gas, propylene gas and mixture gas of these gases; CO gas; $CO_2$ gas; or vapor of organic solvent such as ethanol and acetone.

The catalyst substance may be: metal selected from a group consisting of Fe, Co, Pd and Ni; organic or inorganic substance having such metal as the main composition; or alloy made of at least two of the above-described metals, these substances functioning as nuclei for forming fibers.

If a substance which contains Pd and/or Ni is used, it is possible to form graphite nanofibers at a relatively low temperature (at least as low as 400° C.). If a substance which contains Fe and/or Co is used, a temperature at which carbon nanotubes are formed is required to be 800° C. or higher. Since graphite nanofibers can be formed at a relatively low temperature if the substance which contains Pd and/or Ni is used, it is preferable in that other components are less adversely affected, power consumption can be suppressed, and manufacture cost is low.

By using the characteristics that oxide of Pd is reduced by hydrogen at a low temperature (room temperature), it becomes possible to use palladium oxide as the nuclei forming substance.

If palladium oxide is subjected to a hydrogen reduction process, an initial aggregation of nuclei can be formed at a relatively low temperature (200° C. or lower) without using thermal aggregation of metal thin films or formation and vapor deposition of ultra fine particles which has been used conventionally as a general nuclei forming technique.

An example of a method of manufacturing an electron-emitting device of this invention will be described with reference to the accompanying drawings.

Figure 1:
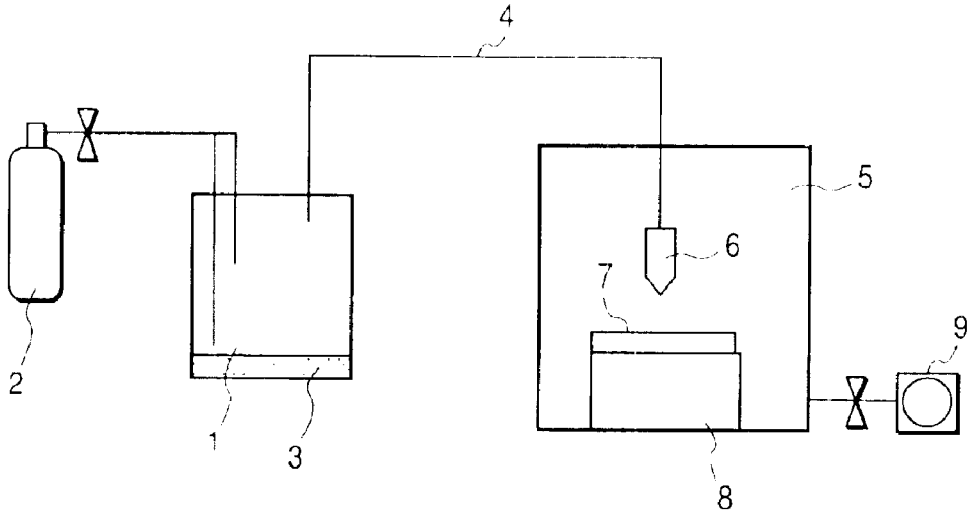
FIG. 1 is a schematic diagram showing an example of a manufacture system of the invention.
Figure 2:
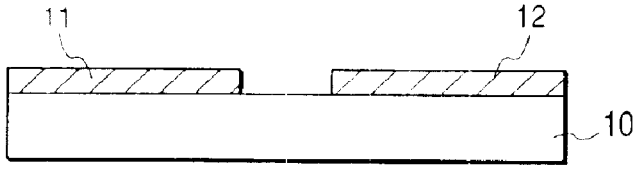
FIG. 2 is a schematic cross sectional view of electrodes formed on a substrate.
Figure 3:
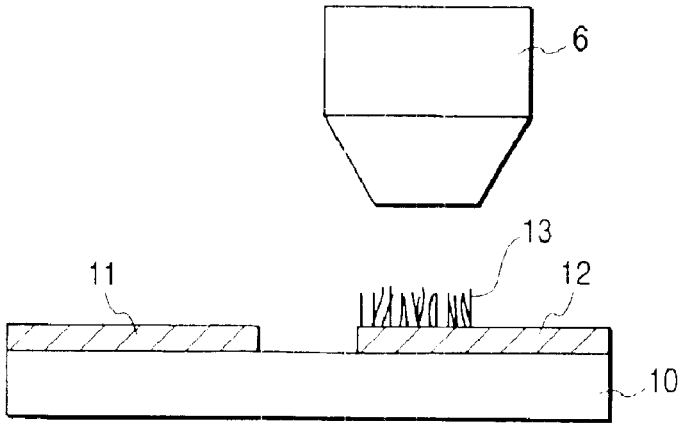
FIG. 3 is a schematic cross sectional view showing an example of an electron-emitting device of the invention.
Figure 4A:
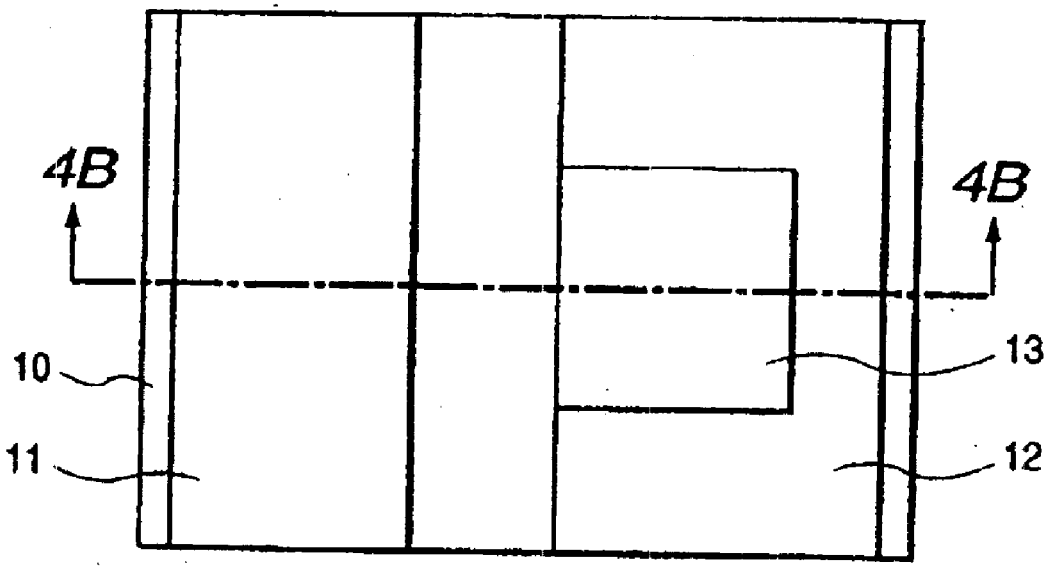
FIGS. 4A and 4B are a schematic plan view and a schematic cross sectional view showing an example of an electron-emitting device of the invention.
Figure 4B:
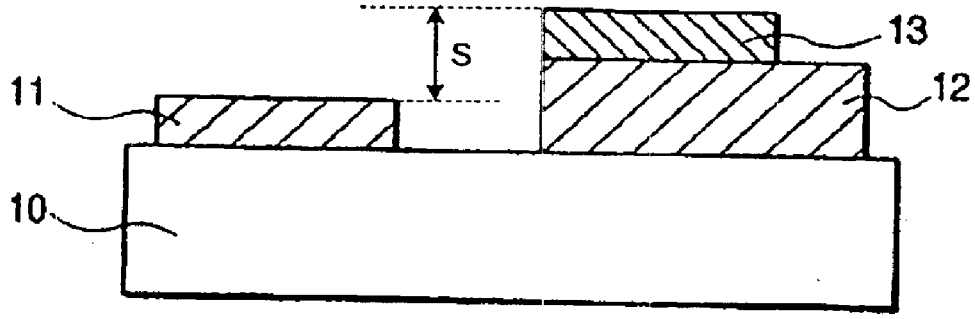

FIG. 1 is a schematic diagram showing an example of a manufacture system used by the invention. FIG. 2 is a schematic cross sectional view of electrodes 11 and 12 formed on a substrate 10. FIG. 3 is a schematic cross sectional view showing an example of an electron-emitting device of the invention. FIGS. 4A and 4B are a schematic plan view and a schematic cross sectional view showing an example of an electron-emitting device of the invention.

According to the invention, fibers comprising carbon as the main composition prepared separately are disposed in a first chamber 1, and a substrate 7 with electrodes is disposed in a second chamber 5. Fibers comprising carbon as the main composition are intended to be fixed to the substrate. The first and second chambers communicate with each other via a transport tube 4. The pressure in the first chamber 1 is set higher than that in the second chamber 5. This pressure difference transports aerosolized fibers comprising carbon as the main composition into the second chamber via the transport tube 4, and the aerosolized fibers comprising carbon as the main composition are ejected at high speed from a nozzle 6 mounted at the end of the transport pipe 4 toward the substrate. Heat energy is generated when the aerosolized fibers with the substrate 7 (or the electrodes on the substrate) at high speed. This heat energy fixes the fibers to the substrate 7 without using adhesive. Reference numeral 3 in FIG. 1 represents a ultra fine particle material (fibers comprising carbon as the main composition).

As an example of a fixing method, an aerosol type gas deposition method may be used. With the aerosol type gas deposition method used by the invention, fibers prepared separately and comprising carbon as the main composition in an aerosolizing chamber (first chamber) 1 are aerosolized by aerosolizing gas introduced from an aerosolizing gas cylinder 2 into the aerosolizing chamber. The aerosolized fibers comprising carbon as the main composition are transported from the aerosolizing chamber 1 into the film forming chamber (second chamber) 5 by using a difference between the pressure in the aerosolizing chamber 1 and that in the film forming chamber 5. The aerosolized fibers comprising carbon as the main composition as well as the aerosolizing gas is ejected from the nozzle 6 mounted at the end of the transport pipe 4 positioned in the film forming chamber 5 toward the substrate 7 to fix (bond) the fibers to the substrate 7.

The gas (transport gas) for aerosolizing fibers comprising carbon as the main composition may by inert gas such as nitrogen gas, helium gas or mixture gas thereof. Non-oxidizing gas is particularly suitable. With such gas, fibers comprising carbon as the main composition such as carbon nanotubes or graphite nanofibers whose size is in the order of submicron are aerosolized in the upper space of the aerosolizing chamber. The aerosolized fibers are sucked into a sucking port located at the top of the aerosolizing chamber and transported via the transport pipe 4 into the film forming chamber (second chamber) to which a vacuum exhaust pump is coupled. The fibers are ejected from the nozzle 6 mounted at the end of the transport pipe 4, collide with the substrate 7 placed on a stage 8, and fixed (bonded) thereto.

In this invention, the substrate 7 is fixed to the stage 8 in the second chamber 5, and the stage 8 is moved so that fibers comprising carbon as the main composition of a desired quantity can be fixed to the substrate in a desired area. By changing the motion speed of the stage 8, the density of fibers comprising carbon as the main composition to be fixed can be changed. The nozzle 6 is also movable. By finely adjusting the relative positions of the nozzle 6 and stage 8, it is possible to finely and reliably fix (bond) fibers comprising carbon as the main composition to the substrate.

In this invention, it is preferable that during a film forming process, the inside of the film forming chamber (second chamber) 5 is evacuated by the vacuum exhaust pump 9 and maintained to be a reduced pressure state (vacuum state lower than 760 Torr). This is because the mean free path of aerosolized fibers comprising carbon as the main composition ejected from the nozzle 6 in the reduced pressure state becomes longer by about a three-digit as compared to the case wherein fibers are ejected at a normal pressure (atmospheric pressure), and the fibers are hard to be affected by the scattering effects.

More specifically, aerosolized fibers comprising carbon as the main composition ejected in the air are scattered and the kinetic energy is lost. It is therefore difficult or almost impossible to bond the fibers to a substrate. However, aerosolized fibers comprising carbon as the main composition ejected from the nozzle 6 in the film forming chamber (second chamber) 5 in the reduced pressure state can be collided with the substrate (or the electrodes on the substrate) with a larger kinetic energy. This kinetic energy is converted into heat energy which contributes to bond the fibers (each end in the longitudinal direction of each fiber) to the substrate, this fixation being the object of the invention.

Not all the fibers comprising carbon as the main composition transported are fixed (bonded) to the substrate (or electrode), but there is a high probability that the fibers ejected with their longitudinal direction ("fiber axial direction" shown in FIGS. 6A to 6C and 7A to 7C) directed to the vertical direction to the substrate plane and electrode planes above the substrate are tightly fixed (bonded) to the substrate and electrodes. This may be ascribed to that when the fibers ejected from the nozzle 6 are fixed (bonded) to the substrate (or the electrodes) with the heat energy converted from the kinetic energy of the fibers and generated upon collision of the fibers on the substrate (or the electrodes), the smaller the collision area, the more the heat energy is concentrated upon the collision area so that the fibers are likely to be fixed (attached). At the moment that the fiber collides with the substrate (or the electrode), the collision area of the fiber (preferably, as described above, an end (end portion) in the longitudinal direction of the fiber) seems to be melted.

It is preferable that fibers comprising carbon as the main composition are straight and cylindrical carbon fibers not curved such as shown in FIGS. 6A to 6C because carbon fibers standing substantially upright on the surface of the substrate 7 and the electrode surfaces above the substrate can be fixed to the substrate and electrodes. Also in this invention, if fibers collide to the substrate (or the electrodes) along a direction different from the "fiber axial direction", the collision area increases greatly so that the fibers are difficult to be fixed (attached) to the substrate (or the electrodes). It is therefore preferable that in order to stably fix fibers to the substrate (or the electrodes), the fiber diameter is several nm to several hundreds nm (more preferably several nm or larger and 100 nm or smaller) and the length there of is ten times or more and one hundred times or less of the diameter. In this invention, it is therefore preferable to use carbon nanotubes having a relatively high linearity as the fibers comprising carbon as the main composition. From the above-described reasons, according to the manufacture method of the invention, carbon fibers fixed to the substrate and electrodes have essentially the "fiber axial direction" substantially perpendicular to the substrate surface and electrode surfaces. According to the invention, it is therefore easy to fix carbon fibers substantially vertically to the substrate surface and electrode surfaces. Accordingly, if an electron-emitting member is made of a number of carbon fibers disposed on a substrate by the manufacture method of the invention, an electric field having a high intensity can be applied to the end of each fiber so that electron emission at a lower voltage is possible.

In this invention, it is preferable that colliding aerosolized fibers comprising carbon as the main composition to the substrate (or the electrodes) is performed while the substrate is heated. This heating can improve tight contactness between the fibers comprising carbon as the main composition and the substrate (or the electrodes).

By moving the stage which holds the substrate while aerosolized fibers comprising carbon as the main composition are ejected from the nozzle, it is possible to continuously fix the fibers comprising carbon as the main composition to the substrate. If masking using a metal mask or a resist mask is performed, fibers comprising carbon as the main composition can be fixed to the substrate only in a desired area.

Aerosol of fibers comprising carbon as the main composition (gas dispersed with fibers comprising carbon as the main composition) is ejected from the nozzle 6 toward the substrate 7 preferably at a flow rate of 0.1 l/min or more, preferably at a flow rate of 1 l/min or more. Fibers comprising carbon as the main composition are ejected from the nozzle 6 toward the substrate 7 preferably at a speed of 0.1 m/sec or more, more preferably at a speed of 1 m/sec or more, or most preferably at a speed of 10 m/sec or more. In order to realize such flow rate and/or speed, the pressures in the first chamber 1 and second chamber 5 are properly set. A distance between the nozzle 6 and substrate 7 is preferably 10 cm or shorter, or more preferably 1 cm or shorter.

The substrate 7, 10 may be a quartz glass substrate, a glass substrate with reduced impurity contents such as Na partially replaced with K or the like, a soda lime glass substrate, a laminated substrate of a silicon substrate or the like laminated with $SiO_2$ by sputtering or the like, a ceramic insulating substrate such as alumina, or the like.

The material of the device electrode 11, 12 formed on the substrate is a general conductive material selected from a group consisting of, for example, carbon; metal such as Ni, Au, Mo, W, Pt, Ti, Al, Cu and Pd or alloy thereof; nitride of such metal (e.g., nitride of Ti); carbide of such metal; boride of such metal; transparent conductive material such as $In_2O_3$—$SnO_2$; semiconductor material such as polysilicon; and the like.

Preferably, the material of the device electrode formed on the substrate is selected from electroconductive materials of which Young's modulus not greater than 15. Further, as material constituting the electrode, the electroconductive materials of which Young's modulus is not greater than 10 are more desirable. Concrete examples of the electroconductive material of such Young's modulus are metals such as Sn, In, Au, Ag, Cu and Al, electroconductive materials containing at least two selected from the metals, alloys of the metals, or material containing as a main ingredient one or ones selected from the metals. According to the manufacturing method of the present invention, since the electrode is formed from the electroconductive material of Young's modulus not greater than 15, when the fiber containing carbon mainly collides with the electrode under the above described condition, the fiber containing carbon mainly is readily fixed onto the electrode (e.g. cathode).

After the substrate 7, 10 is cleaned sufficiently with detergent, pure water, organic solvent or the like, electrode material is deposited on the substrate by vapor deposition, printing, sputtering or the like. Thereafter, the electrode material is worked by, for example, photolithography, to form electrodes having desired shapes.

The distance between device electrodes 11 and 12, the length of each device electrode, the shape of each device electrode and the like are properly designed in accordance with the application field. The distance between the device electrodes is preferably several nm or longer and several hundreds μm or shorter, or more preferably in the range from 1 μm or longer to 100 μm or shorter depending upon the voltage applied across the electrodes and the like. The device electrode length is in the range from several μm or longer to several hundreds μm or shorter depending upon the electrode resistance value, electron emission characteristics and the like. The device electrode thickness is set in a range from several tens nm or longer to several tens μm or shorter.

Figure 5:
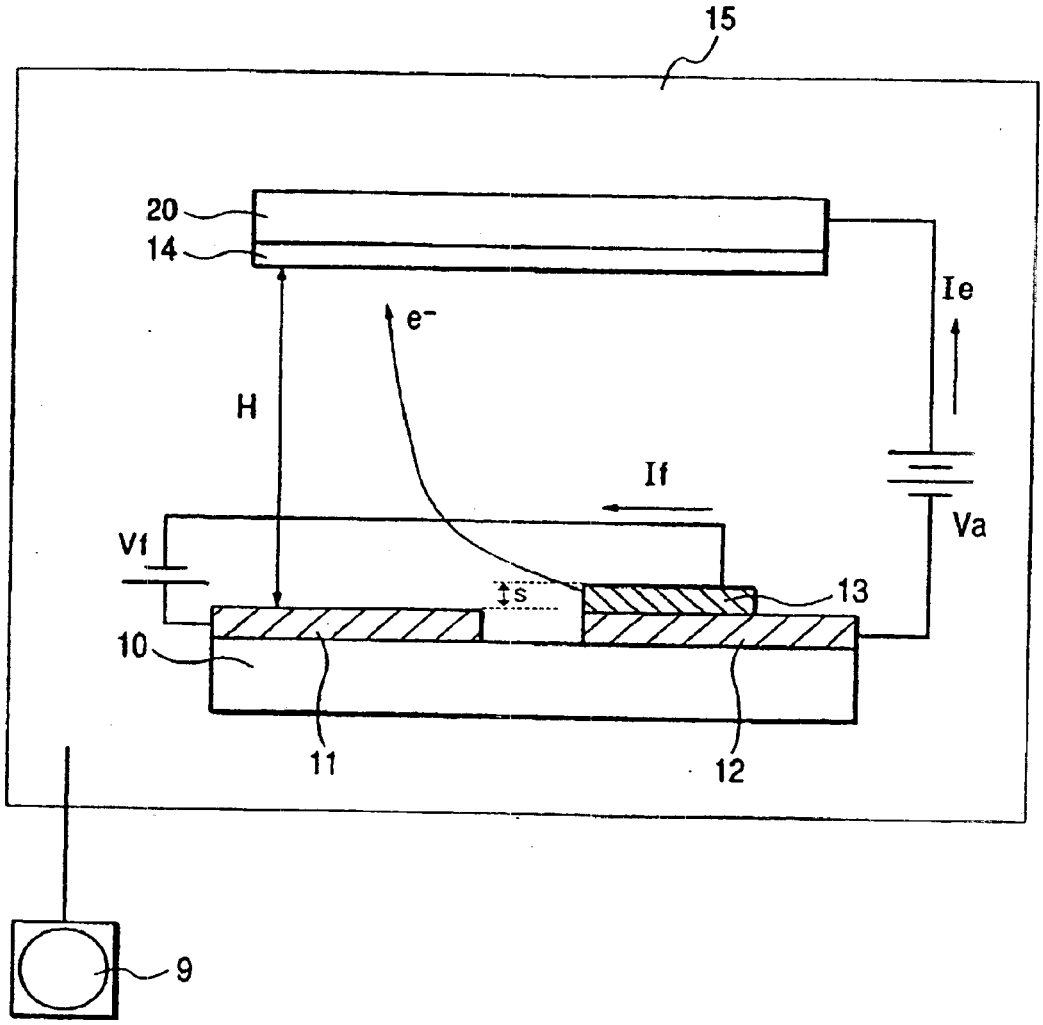
FIG. 5 is a diagram showing the outline structure of an evaluation system for measuring electron emission characteristics.

The electron-emitting device manufactured by the manufacture method of the invention may take various structures. For example, as shown in FIG. 5, as a preferred structure of the electron-emitting device, on the surface of a substrate 10, a drawing electrode (called a "gate electrode" where appropriate) 11 and a cathode electrode 12 are disposed spaced from each other. Fibers 13 comprising carbon as the main composition are disposed on the cathode electrode 12 by the manufacture method of the invention. FIG. 5 is a schematic diagram showing the outline structure of an evaluation system for measuring the electron emission characteristics of an electron-emitting device manufactured by the manufacture method of the invention. In FIG. 5, reference numeral 9 represents a vacuum exhaust pump, reference numeral 14 represents a phosphor, reference numeral 15 represents a vacuum system, and reference numeral 20 represents an anode electrode for capturing an emission current Ie emitted from an electron-emitting portion (fibers comprising carbon as the main composition) of the device.

An electron-emitting device having a gap of several μm between the drawing electrode and cathode electrode as well as the anode electrode 20 are installed in the vacuum system 15 shown in FIG. 5. The inside of the vacuum system 15 is sufficiently evacuated by the vacuum exhaust pump 9 to a pressure of about $10^{-5}$ Pa. The distance H between the substrate and anode electrode 20 is several mm, for example, 2 mm or longer and 8 mm or shorter. As shown in FIG. 5, a high voltage source applies a high voltage Va of several kV, for example, 1 kV or higher and 10 kV or lower, to the anode electrode 20.

Upon application of a drive voltage (device voltage) Vf of about several tens V and the anode voltage Va, electrons are emitted and the electron emission current Ie is obtained. A device current is represented by If.

It is preferable for the electron-emitting device that in order to suppress scattering on the gate electrode 11, the plane substantially in parallel to the substrate 10 surface including the surface of the fibers 13 is positioned more remotely from the substrate 10 surface than the plane substantially in parallel to the substrate 10 surface including the partial surface of the gate electrode 11 (refer to FIGS. 4A, 4B and 5). In other words, it is preferable for the electron-emitting device of the invention that the plane substantially in parallel to the substrate 10 surface including the surface of the fibers 13 is positioned between the anode electrode 20 and the plane substantially in parallel to the substrate 10 surface including the partial surface of the lead electrode 11 (refer to FIGS. 4A, 4B and 5).

It is also preferable for the electron-emitting device of the invention that in order to substantially eliminate scattering on the gate electrode 11, the fibers 13 having carbon as the main composition are positioned at a height s (distance between the plane substantially in parallel to the substrate 10 surface including the surface of the fibers 13 and the plane substantially in parallel to the substrate 10 surface including the partial surface of the gate electrode 11).

The height s depends upon a ratio of the vertical electric field to the horizontal electric field ((vertical electric field intensity)/(horizontal electric field intensity)). The larger the ratio of the vertical electric field to the horizontal electric field, the height becomes greater. The higher the horizontal electric field intensity, the greater height is necessary. A practical range of the height s is from 10 nm or higher to 10 μm or lower.

The "horizontal electric field" used in the invention can be said as "electric field along a direction substantially in parallel to the substrate 10 surface" or "electric field along a direction along which the gate electrode 11 and cathode electrode 12 face each other". The "vertical electric field" used in the invention can be said as "electric field along a direction substantially vertical to the substrate 10 surface" or "electric field along a direction along which the substrate 10 and anode electrode 20 face each other".

In the electron-emitting device of the invention, the electric field (horizontal electric field) E1=Vf/d in a drive state is set to the electric field between the anode electrode and cathode electrode (vertical electric field) E2=Va/H or larger and 50 times of E2=Va/H or smaller, where d is the distance between the cathode electrode 12 and gate electrode 11, Vf is a potential difference between the cathode electrode 12 and gate electrode 11 while the electron-emitting device is driven, H is the distance between the anode electrode 20 and the substrate 10 on which the device is disposed, and Va is a potential difference between the anode electrode 20 and cathode electrode 12.

By setting the electric field in the above-described manner, the number of electrons emitted from the cathode electrode 12 side and bombarded on the gate electrode 11 can be reduced. The spread of emitted electrons can therefore be narrowed and the electron-emitting device having a high efficiency can be obtained.

An example of the electron source manufactured by the method of the invention will be described briefly.

As a layout of electron-emitting devices on a substrate, there are a ladder layout and a matrix layout. In the latter, on m X-directional wirings, n Y-directional wirings are disposed with an interlayer insulating layer being interposed therebetween, and X- and Y-directional wirings are connected to a pair of device electrodes (gate electrode and cathode electrode) of each electron-emitting device. X- and Y-directional wirings are made of conductive metal formed on an electron source substrate by vapor deposition, printing, sputtering or the like. Voltage is applied via the wirings. The interlayer insulating layer is made of $SiO_2$ or the like deposited by vapor deposition, printing, sputtering or the like.

Device electrodes of the electron-emitting devices are electrically connected by m X-directional wirings and n Y-directional wirings and interconnections made of conductive metal or the like deposited by vapor deposition, printing, sputtering or the like.

Next, as an example of the light-emitting apparatus manufactured by the method of the invention, the light-emitting apparatus using an electron source of the matrix layout will be described briefly.

The light-emitting apparatus is mainly constituted of an electron source substrate disposed with electron-emitting devices, a face plate made of a glass substrate on the inner surface of which an inner light-emitting member (phosphor film), a metal back and the like are formed, and a support frame.

The phosphor film is made of only phosphor for a monochromatic phosphor film. For a color phosphor film, the phosphor film is made of phosphor and a black conductive member called a black stripe or black matrix depending upon the layout of phosphor members.

Phosphor is coated on the glass substrate by precipitation or printing. The metal back is formed by depositing Al by vacuum deposition or the like after the inner surface of the phosphor film is subjected to a planarizing process (filming).

Next, an example of an image forming apparatus manufactured by the method of the invention will be described briefly.

The image forming apparatus is mainly constituted of a light-emitting apparatus, a scan circuit, a control circuit, a shift register, a line memory, a sync signal separation circuit, a modulating signal generator and a d.c. voltage source.

The invention will be described in more detail by using embodiments.

First Embodiment

FIG. 2 is a schematic cross sectional view showing a substrate with electrodes according to the embodiment. FIG. 3 is a schematic cross sectional view of an electron-emitting device of the embodiment. In FIGS. 2 and 3, reference numeral 10 represents an insulating substrate, reference numeral 11 represents a lead electrode (gate electrode), reference numeral 12 represents a cathode electrode, and reference numeral 13 represents fibers (emitter) having carbon as the main composition.

The manufacture processes for the electron-emitting device of the embodiment will be described.

First, a quartz glass substrate was prepared as a substrate, washed sufficiently with organic solvent, and then dried at 120° C. On the washed quartz substrate, Ti of 5 nm in thickness and polysilicon (doped with arsenic) of 30 nm in thickness were deposited in succession by sputtering.

Next, by using a resist film patterned by photolithography as a mask, the deposited polysilicon (doped with arsenic) layer and Ti layer were dry-etched by using $CF_4$ gas to form a gate electrode and a cathode electrode having an electrode gap of 5 $\mu$m.

Next, carbon nanotubes prepared in advance were disposed in an aerosolizing chamber, and the substrate with the electrodes formed as described above was disposed in the aerosolizing chamber. Next, helium gas was introduced into the aerosolizing chamber to aerosolize the carbon nanotubes. By utilizing a difference between the pressure (about 200 KPa) in the aerosolizing chamber and the pressure (about 60 Pa) in a film forming chamber, the aerosolized carbon nanotubes were introduced into the film forming chamber via a transport tube communicating with the aerosolizing chamber and film forming chamber. The aerosolized carbon nanotubes were ejected from a nozzle mounted at the end of the transport tube positioned in the film forming chamber toward the area of the substrate to which the carbon nanotubes are desired to be fixed. The carbon nanotubes used were formed by dissolving ethylene gas at a temperature of 800° C. by using Co as catalyst substance.

The substrate to which the aerosolized carbon nanotubes were ejected was observed with a scanning electron microscope. It was confirmed that the carbon nanotubes were fixed generally vertically to the substrate surface (electrode surface).

The electron emission characteristics of the device manufactured in the above manner were measured as in the following. The device was placed in a vacuum system such as shown in FIG. 5, the inside of the vacuum system was evacuated with a vacuum exhaust pump to a pressure of $2\times10^{-5}$ Pa, and an anode voltage Va=10 kV was applied to the anode electrode spaced apart by H=2 mm from the device as shown in FIG. 5. The device current If and electron emission current Ie of the device applied with a drive voltage were measured. It was confirmed that the stable and excellent electron emission characteristics were maintained for a long period.

Second Embodiment

In the manner similar to the first embodiment, a drawing electrode 11 and a cathode electrode 12 were formed on a substrate. In the second embodiment, as shown in FIGS. 4A and 4B, the thickness of the cathode electrode 12 was made thicker than that of the drawing electrode 11. FIG. 4A is a schematic plan view of the electron-emitting device of this embodiment, and FIG. 4B is a schematic cross sectional view taken along line 4B—4B in FIG. 4A.

Next, Cr was deposited on the whole surface of the substrate to a thickness of about 100 nm by EB deposition.

A resist pattern of positive photoresist was formed by photolithography. Next, by using the patterned photoresist as a mask, Cr exposed in an opening of the mask was removed by cerium nitride based etchant to thereby expose a partial surface area (100 $\mu$m square) of the cathode electrode to be covered with electron-emitting members (fibers comprising carbon as the main composition).

After the resist mask was removed, carbon nanotubes are fixed to the substrate in the manner similar to the first embodiment. In this case, the carbon nanotubes were fixed while the substrate was heated to 200° C. The electron emission characteristics of the electron-emitting device of this embodiment were measured in the manner similar to the first embodiment. It was confirmed that the stable and excellent electron emission characteristics were maintained for a long period.

Third Embodiment

In the manner similar to the first embodiment, a drawing electrode and a cathode electrode were formed on a substrate. Next, a metal mask having an opening in the area where electron-emitting members are to be formed was fixed to the substrate.

Next, fibers comprising carbon as the main composition were fixed to the opening area on the substrate in the manner similar to the first embodiment, excepting that the pressure of an aerosolizing chamber was set to about 70 KPa, the pressure of a film forming chamber was set to about 200 Pa and graphite nanofibers were used instead of carbon nanotubes. In this case, fibers were fixed while the substrate was heated to 200° C. The nozzle used for film formation had a slit shape and the substrate was scanned so that the nozzle scanned over the opening.

The electron emission characteristics of the electron-emitting device of this embodiment were measured in the manner similar to the first embodiment. It was confirmed that the stable and excellent electron emission characteristics were maintained for a long period.

As described so far, according to the manufacture method of the invention, it is possible to directly fix fibers comprising carbon as the main composition such as carbon nanotubes and graphite nanofibers to a substrate and to greatly shorten and simplify the processes necessary for electron-emitting device manufacture. Further, since the electron-emitting device manufacture method of the invention can fix carbon nanotubes vertically to the substrate surface, an electric field of a higher intensity can be concentrated upon each fiber having carbon as the main composition. Therefore, an electron-emitting device having excellent electron emission characteristics can be manufactured and also an electron source, a light-emitting apparatus and an image forming apparatus using such electron-emitting devices can be manufactured.

What is claimed is:

1. A method of manufacturing an electron-emitting device, the method comprising:

(A) a step of preparing a plurality of carbon fibers, each of which has two ends, in a first chamber;

(B) a step of preparing a substrate having a solid-state surface without interstices, depressions and wells for anchoring a carbon fiber, in a second chamber; and (C) a step of colliding one of the two ends of each of the fibers with the solid-state surface via a transport tube communicating with the first and second chamber by setting a pressure in the first chamber higher than a pressure in the second chamber, to fix the one of the two ends of each of the fibers to the solid-state surface.

2. A method of manufacturing an electron-emitting device, the method comprising:

(A) a step of preparing fibers in a first chamber;

(B) a step of preparing a substrate with a cathode electrode having a solid-state surface without interstices, depressions and wells for anchoring a carbon fiber, in a second chamber; and (C) a step of colliding one of two ends of each of the fibers with the solid-state surface of the cathode electrode via a transport tube communicating with the first and second chamber by setting a pressure in the first chamber higher than a pressure in the second chamber, to fix the one of the two ends of each of the fibers to the solid-state surface of the cathode electrode.

3. A method according to claim 1 or 2, wherein the fibers are dispersed in gas in the first chamber.

4. A method according to claim 3, wherein the gas is non-oxidizing gas.

5. A method according to claim 1 or 2, wherein an inside of the second chamber is in a reduced pressure state.

6. A method according to claim 1 or 2, wherein the fibers are aerosolized in the first chamber.

7. A method according to claim 1 or 2, wherein the fibers are fixed to the solid-state surface by heat energy generated when the one of the two ends of the fibers collides with the solid-state surface.

8. A method according to claim 1 or 2, wherein the fibers are at least ones selected from a group consisting of graphite nanofibers, carbon nanotubes, amorphous carbon fibers and carbon nanohorns.

9. A method according to claim 1, wherein the solid-state surface further comprises a first conductive region, and the fibers are fixed to the first conductive region.

10. A method according to claim 9, wherein the solid-state surface further comprises a second conductive region, the second conductive region being spaced apart from the first conductive region.

11. A method of manufacturing an electron source having a plurality of electron-emitting devices, wherein each electron-emitting device is manufactured by the method as recited in claim 1 or 2.

12. A method of manufacturing an image forming apparatus having an electron source and a light emitting member wherein the electron source is manufactured by the method as recited by claim 11.

13. A method of manufacturing a light-emitting apparatus having electron-emitting devices and light-emitting members, wherein each electron-emitting device is manufactured by the method as recited in claim 1 or 2.

14. A method of manufacturing a substrate having a number of fibers, comprising:

(A) a step of preparing fibers in a first chamber;

(B) a step of preparing a substrate having a solid-state surface without interstices, depressions and wells for anchoring a carbon fiber, in a second chamber, and (C) a step of colliding one of two ends of each of the fibers with the solid-state surface via a transport tube communicating with the first and second chamber by setting a pressure in the first chamber higher than a pressure in the second chamber, to fix the one of the two ends of each of the fibers to the solid-state surface.

15. A method according to claim 1 or 2, wherein Young's modulus of the solid-state surface is not greater than 15 $N/m^2$.

16. A method according to claim 9, wherein said first conductive layer contains at least one metal element selected from Sn, In, Au, Ag and Cu.

17. A method of manufacturing an electron source having a plurality of electron-emitting devices, wherein each electron-emitting device is manufactured by the method as recited in any one of claims 14 and 16.

18. A method of manufacturing an image forming apparatus having an electron source and a light emitting member wherein the electron source is manufactured by the method as recited by claim 17.

19. A method of manufacturing a light-emitting apparatus having electron-emitting devices and light-emitting members, wherein each electron-emitting device is manufactured by the method as recited in any one of claims 14 and 16.

20. A method according to claim 14, wherein Young's modulus of the solid-state surface is not greater than 15 $N/m^2$.

21. A method of manufacturing an electron source having a plurality of electron-emitting devices, wherein each electron-emitting device is manufactured by the method as recited in claim 15.

22. A method of manufacturing an image forming apparatus having an electron source and a light emitting member wherein the electron source is manufactured by the method as recited by claim 21.

23. A method of manufacturing a light-emitting apparatus having electron-emitting devices and light-emitting members, wherein each electron-emitting device is manufactured by the method as recited in claim 15.

* * * * *

UNITED STATES PATENT AND TRADEMARK OFFICE

CERTIFICATE OF CORRECTION

PATENT NO. : 6,948,995 B2
APPLICATION NO. : 10/234213
DATED : September 27, 2005
INVENTOR(S) : Junri Ishikura et al.

It is certified that error appears in the above-identified patent and that said Letters Patent is hereby corrected as shown below:

ON COVER PAGE AT (56) FOREIGN PATENT DOCUMENTS

"JP 2002-123711 4/2000" should read --JP 2000-123711 4/2000--;
"JP 2001-288625 A 1/2001" should read --JP 2001-288625 A 10/2001--; and
"JP 2000/277003 10/2000" should read --JP 2000-277003 10/2000--.

ON COVER PAGE AT (56) OTHER PUBLICATIONS

"W.P. Dkye" should read --W.P. Dyke--
After "Hisashi Araki et al,.": "Electroforming" should read --"Electroforming--; and "Films," should read --Films", --;
After "A.M. Rao et al.,": "Array of" should read --Array--;
After "Cheol Jin Lee et al,": "Sodal-" should read --Soda---; and "ime-" should read --lime--;
After "Sashiro Uemura et al.,": "Graphi-" should read --Graphite---; and "te-" should be deleted.

COLUMN 1

Line 54, "catalyst" should read --catalyst metal--; and
Line 67, "adhesive" should read --the adhesive--.

COLUMN 2

Line 7, "a electrode" should read --an electrode--;
Line 20, "ingredients." should read --ingredients).--;
Line 34, "(bonded)" should read --(bond)--;
Line 38, "used also" should read --used serve also--; and
Line 52, "collides" should read --collide--.

COLUMN 3

Line 12, "catalyst" should read --a catalyst--;
Line 28, "face. An" should read --face, an--; and
Line 32, "used to" should read --used in--.

UNITED STATES PATENT AND TRADEMARK OFFICE

CERTIFICATE OF CORRECTION

PATENT NO. : 6,948,995 B2
APPLICATION NO. : 10/234213
DATED : September 27, 2005
INVENTOR(S) : Junri Ishikura et al.

It is certified that error appears in the above-identified patent and that said Letters Patent is hereby corrected as shown below:

COLUMN 4

Line 63, “Comparing to” should read --In comparison to--.

COLUMN 5

Line 1, “comprising of” should read --comprised of--;
Line 26, “decompose” should read --decomposing--; and
Line 49, “characteristics that oxide” should read --characteristic that the oxide--.

COLUMN 6

Line 36, “is ejected” should read --are ejected--; and
Line 53, “fixed” should read --are fixed--.

COLUMN 7

Line 1, “to be a” should read --at a--;
Line 7, “hard to be affected” should read --hardly affected--;
Line 29, “ascribed to” should read --ascribed to the fact--;
Line 46, “collide to” should read --collide with--;
Line 49, “difficult to be fixed (attached)” should read --difficult to fix (attach)--; and
Line 54, “there of” should read --thereof--.

COLUMN 8

Line 6, “contactness” should read --contact--; and
Line 46, “Young's modulus” should read --the Young's modulus is--.

COLUMN 11

Line 47, “KPa)” should read --kPa)--.

UNITED STATES PATENT AND TRADEMARK OFFICE

CERTIFICATE OF CORRECTION

PATENT NO. : 6,948,995 B2
APPLICATION NO. : 10/234213
DATED : September 27, 2005
INVENTOR(S) : Junri Ishikura et al.

It is certified that error appears in the above-identified patent and that said Letters Patent is hereby corrected as shown below:

COLUMN 12

Line 45, "KPa," should read --kPa,--.

Signed and Sealed this

Seventeenth Day of October, 2006

JON W. DUDAS
*Director of the United States Patent and Trademark Office*